United States Patent [19]

Kim

[11] Patent Number: 4,670,982

[45] Date of Patent: Jun. 9, 1987

[54] HAIR CUTTER

[76] Inventor: Daniel S. Y. Kim, 411 NE. 87th Ave., Vancouver, Wash. 98664

[21] Appl. No.: 794,462

[22] Filed: Nov. 4, 1985

[51] Int. Cl.[4] ..... B26B 11/00

[52] U.S. Cl. ..... 30/133; 30/206

[58] Field of Search ..... 30/133, 41, 41.5, 263, 30/264, 265, 240, 206

[56] References Cited

U.S. PATENT DOCUMENTS 512,009 1/1894 Chaney ..... 30/206

4,150,483 4/1979 Kanazawa ..... 30/133

4,314,405 2/1982 Park ..... 30/133

4,473,945 10/1984 Nagel ..... 30/133

*Primary Examiner*—Douglas D. Watts

*Attorney, Agent, or Firm*—Lee R. Schermerhorn

[57] ABSTRACT

An open bottom housing containing motor driven cutting blades is placed on the head and the hair if drawn up into the housing and through the cutting blades by an upward air flow through the housing. This air flow is produced by a suction connection at the top of the housing actuated by an ordinary vacuum cleaner. A plurality of feet around the bottom opening rest on the scalp to provide an air inlet for the upward air flow.

4 Claims, 9 Drawing Figures

HAIR CUTTER

BACKGROUND OF THE INVENTION

This invention relates to a hair cutter for cutting hair on the head to a predetermined length.

Cutting hair with scissors has a number of disadvantages. It is a slow process and requires a great deal of expertise to produce an acceptable result. Even with considerable experience it is practically impossible for a person to give himself or herself a complete hair cut. A barber is necessary and finding a good barber presents another problem.

Then there is the bother of disposing of the cut ends of the hair. A barber shop is designed to handle this problem but a private home or apartment is not.

There is a need for a device that will enable a person to cut his or her own hair and that will enable even a good barber to perform the operation in less time.

There is also the need for a device that will enable a person conveniently to cut his or her own hair quickly every day to maintain the same length at all times and keep the hairstyle nice looking at all times.

SUMMARY OF THE INVENTION

The present device will accomplish the above desirable results without any particular skill or practice by the user of the device.

An open bottom housing containing motor driven cutting blades is placed on the head and the hair is drawn up into the housing and through the cutting blades by an upward air flow through the housing. This air flow is produced by a suction connection at the top of the housing actuated by an ordinary vacuum cleaner. A plurality of feet around the bottom opening rest on the scalp to provide an air inlet for the upward air flow.

The supporting feet are preferably mounted on the lower end of a tube extending downward from the bottom of the housing. This tube is provided with removable sections to adjust the length of the hair by raising or lowering the housing.

There is no problem of disposal of the cut ends of the hair. They are all cleanly removed and deposited in the vacuum cleaner as fast as they are cut.

The invention will be better understood and additional features and advantages will become apparent from the following description of the preferred embodiment illustrated in the accompanying drawings. Various changes may be made in the details of construction and arrangement of parts and certain features may be used without others. All such modifications within the scope of the appended claims are included in the invention.

DESCRIPTION OF THE PREFERRED EMBODIMENT

Figure 1:
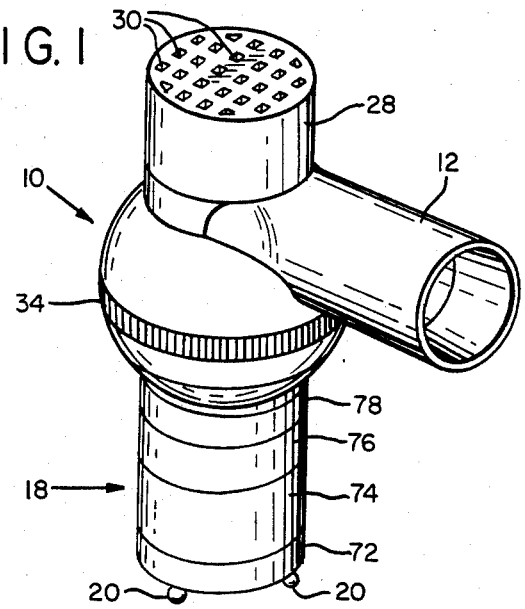
FIG. 1 is an isometric view of the hair cutter of the invention.
Figure 2:
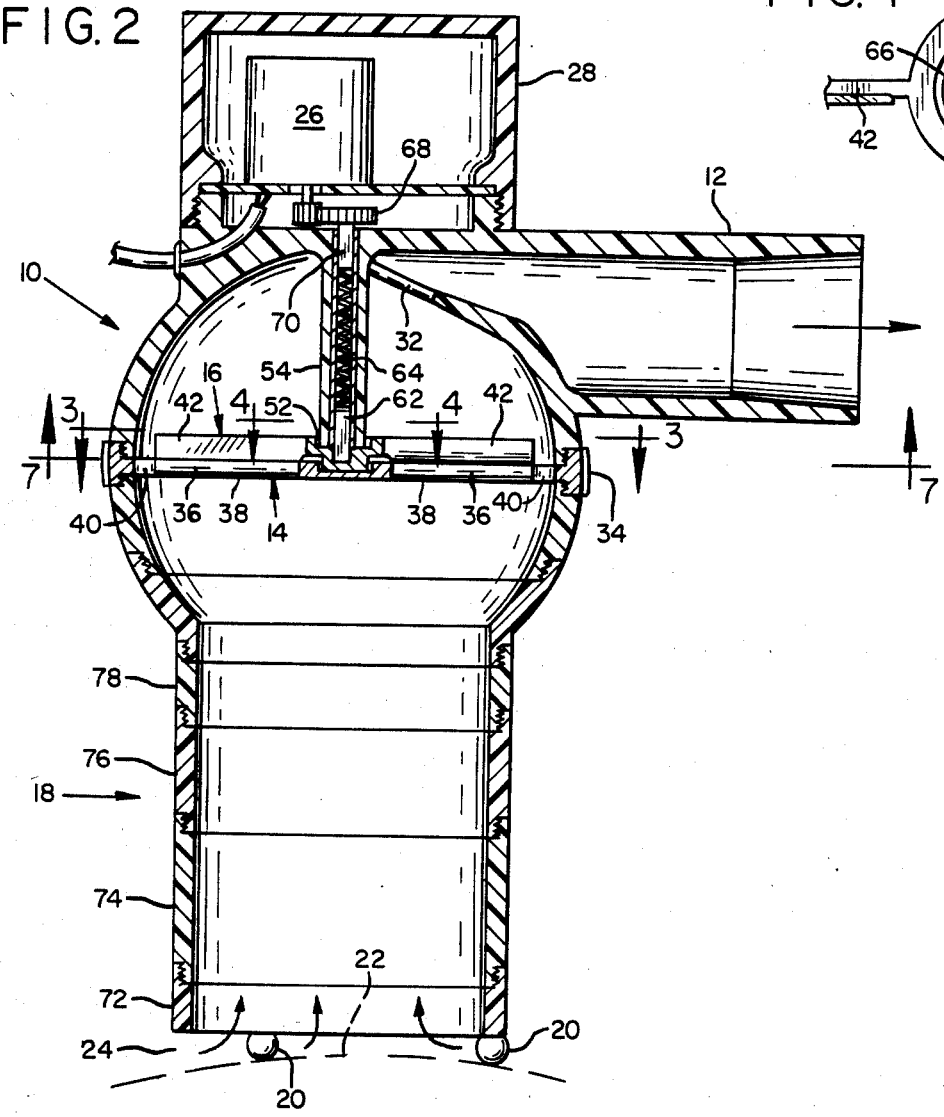
FIG. 2 is an enlarged vertical section view.

As shown in FIGS. 1 and 2, the approximately spherical housing 10 is equipped in its upper portion with an air suction connection 12 to produce an upward air flow through a stationary cutter blade unit 14 and a rotary cutter blade unit 16.

Housing 10 has an open bottom connected with an air inlet tube 18. The lower end of tube 18 is equipped with three ball shaped feet 20 to bear on the scalp 22 having the hair to be cut. This provides a circular air inlet opening 24 to draw in air between the scalp and the lower end of tube 18 in an upward flow of sufficient velocity to lift the hair up through the horizontal cutter blade units 14 and 16.

Rotating cutter blade unit 16 is driven by an electric motor 26 in a separate motor housing 28. Top openings 30 provide for ventilation of the motor housing independently of the air flow through housing 10.

Air suction connection 12 is adapted to be connected to the suction hose of a conventional household vacuum cleaner. This suction connection communicates with the upper central portion of housing 10 through an opening 32 through which the cut ends of the hair are removed.

Figure 3:
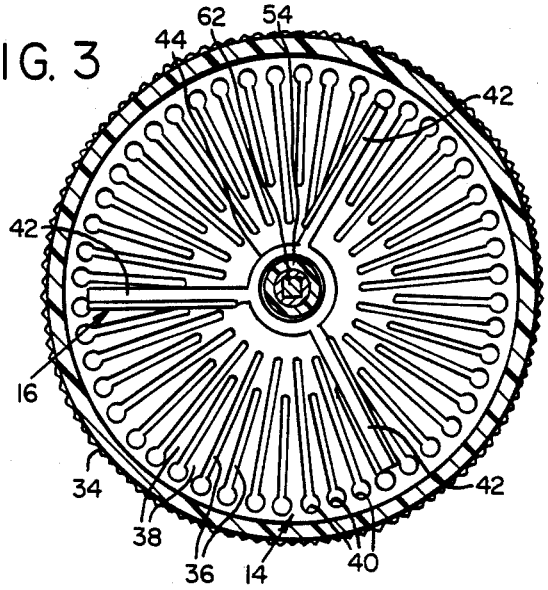
FIG. 3 is a view on the line 3—3 in FIG. 2.
Figure 4:
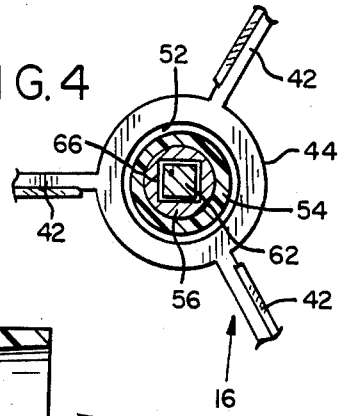
FIG. 4 is a view on the line 4—4 in FIG. 2.
Figure 9:
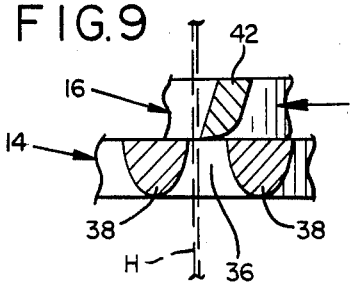
FIG. 9 is a fragmentary section view through the stationary blade unit and one of the blade arms of the rotary blade unit.
Figure 7:
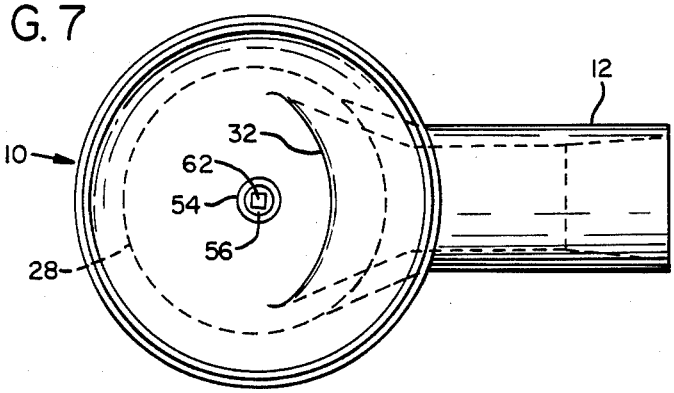
FIG. 7 is a view on the line 7—7 in FIG. 2.
Figure 8:
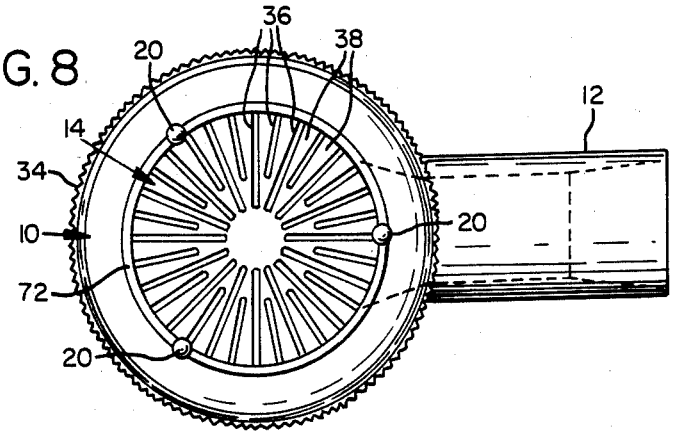
FIG. 8 is a bottom plan view of the cutter.

Stationary blade unit 14 is mounted in the housing by means of a peripheral circular threaded ring 34 which interconnects separate upper and lower portions of housing 10. As seen in FIGS. 3 and 9, stationary blade unit 14 is for the most part a flat horizontal plate containing radial slots 36. The plate portions 38 between these slots provide shearing edges for cutting hair drawn up through the slots by the upward air flow. The outer ends of slots 36 are enlarged at 40 for a purpose which will presently be explained.

Rotating blade unit 16 has three blade arms 42 mounted on a central hub 44. The cutting edges of these blade arms are disposed at small angles from radial directions whereby rotation of the blade arms produces a scissors-type shearing action on hair extending through the slots 36, as seen in FIG. 3. FIG. 9 illustrates this action on a hair H.

The cutting edges of blades 42 bear against stationary cutting plate 38 in scissors action with no space between the stationary and rotating cutting edges, making the blades self sharpening. Any uncut hair that may be pushed along the stationary cutting edges by movement of the rotary cutting edges is pushed out temporarily into the wide end portions 40 of the slots 36, beyond the ends of rotary cutting blades 42. These uncut hairs will be moved back into the slots 36 by the air flow and by movement of housing 10 over the head, whereby such uncut hairs are promptly cut.

Figure 5:
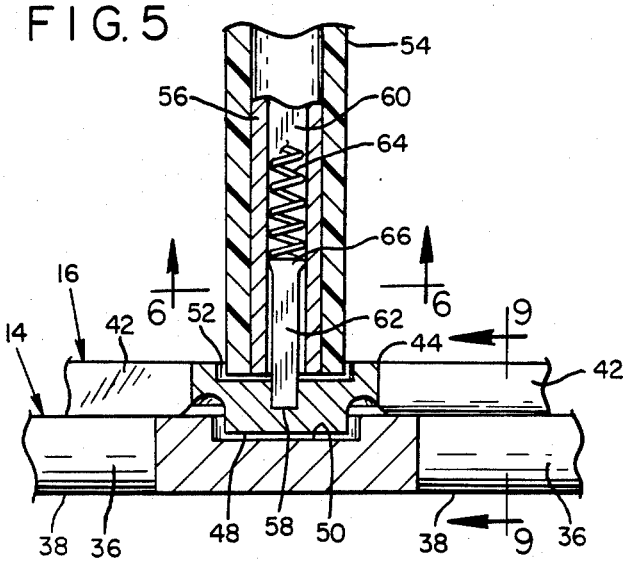
FIG. 5 is an enlarged portion of FIG. 2, showing the drive connection with the rotating cutter blade unit.
Figure 6:
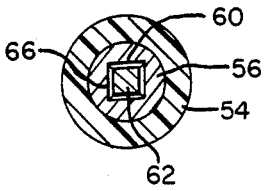
FIG. 6 is a view on the line 6—6 in FIG. 5.

A central portion 48 of hub 44 is centered for rotation in a central depression 50 in stationary plate 38 but does not seat in this depression, as shown in FIG. 5. A central circular depression 52 in the upper side of hub 44 receives the lower end of a guide tube 54 containing a hollow drive shaft 56.

Shaft 56 has a square shaped central opening 60 containing a square lower stub drive shaft 62 which is seated in a square opening 58 in hub 44 by the action of compression spring 64. Stub shaft 62 has an enlarged square upper end 66 which fits and slides in the square opening 60, but the lower portion of stub shaft 62 is of smaller dimensions to permit a small angle of tilt of the stub shaft to accommodate lack of precise alignment of the vertical axes of hub 44 and drive shaft 56.

As seen in FIG. 2 a motor driven gear 68 drives an upper square stub shaft 70 fixed in the upper end of drive shaft 56 to turn the rotary blade unit 16. The lower end of stub shaft 70 provides an abutment for the upper end of compression spring 64.

Also as shown in FIG. 2, the tube 18 contains removable sections 72, 74, 76 and 78 to vary the distance from the scalp 22 up to the cutting blade units 14 and 16. These sections are screw threaded together so that one or more may be removed to produce a shorter hair cut. Bottom section 72 is retained in any event, this section being screwed on to the lowest section retained. If all three sections 74, 76 and 78 are removed, then section 72 is screwed directly on to the lower end of housing 10 in a position presently occupied by section 78.

Thus the present hair cutter automatically provides for the desired length of hair cut without relying on the operator's accuracy of perception and judgement and insuring uniform length of hair on opposite sides of the head, without the usual trial and error visual comparisons as the cutting proceeds. The upward air flow is directed uniformly through the whole area of operation of the cutter and the cut ends of the hair are deposited in the dust receptacle of the vacuum cleaner which furnishes the suction in suction connection 12.

What is claimed is:

1. A hair cutter comprising a housing containing a horizontal stationary blade unit and a rotary blade unit in engagement therewith for cutting the hair, said housing having an open bottom provided with feet to engage a scalp having hair to be cut, said feet providing an open space between said scalp and housing to admit an air flow into said open bottom, a suction tube connection on said housing above said blade units for introducing air suction to draw hair from said scalp up through said blade units, a motor driving said rotary blade unit, a vertical guide tube above said blade units, a hollow drive shaft in said guide tube having a square open center, a motor driven square stub shaft in the upper end of said drive shaft a square stub shaft in the lower end of said drive shaft in driving engagement with said rotary blade unit, and a coil spring in said drive shaft compressed between the confronting ends of said stub shafts.

2. A hair cutter as defined in claim 1, the lower end of said lower square stub shaft being seated in a square hole in said rotary blade unit and the upper end of said lower stub shaft having an enlarged head in said drive shaft.

3. A hair cutter as defined in claim 2, said rotary blade unit being seated for rotation on said stationary blade unit.

4. A hair cutter comprising a housing containing a horizontal stationary blade unit and a rotary blade unit in engagement therewith for cutting the hair, said housing having an open bottom with feet to engage a scalp having hair to be cut, said feet providing an open space between said scalp and housing to admit an air flow into said open bottom, a suction tube connection on said housing above said blade units for introducing air suction to draw hair from said scalp up through said blade units, a motor driving said rotary blade unit continuously in one direction, said rotary blade unit comprising a small number of radial blade arms, said stationary blade unit being supported in said housing by a circular peripheral edge portion beyond the ends of said rotary blade arms and having a large number of radial slots forming radial cutting blades between said slots, said slots extending beyond the ends of said rotary blade arms and being widened in said extended portions to receive temporarily any uncut hairs that have been pushed outwardly along the slots by the rotary blades.

* * * * *